United States Patent [19]

Brocklehurst

[11] Patent Number: 4,595,133

[45] Date of Patent: Jun. 17, 1986

[54] TOWEL ALIGNING, CUTTING AND HEMMING SYSTEM

[75] Inventor: Charles E. Brocklehurst, Fountain Inn, S.C.

[73] Assignee: Opelika Manufacturing Corporation, Chicago, Ill.

[21] Appl. No.: 690,457

[22] Filed: Jan. 10, 1985

Related U.S. Application Data

[63] Continuation-in-part of Ser. No. 621,935, Jun. 18, 1984.

[51] Int. Cl.[4] ..... B65H 23/16

[52] U.S. Cl. ..... 226/34; 226/44; 112/318

[58] Field of Search ..... 112/121.12, 141, 306, 112/311, 314, 318, 322, 121.11; 226/10, 35, 34, 44; 83/367

[56] References Cited

U.S. PATENT DOCUMENTS

| | | | |
|---|---|---|---|
| 2,716,266 | 8/1955 | MacIsaac, Jr. et al. | 226/10 X |
| 3,704,820 | 12/1972 | Frederick et al. | 226/34 |
| 4,034,634 | 7/1977 | Arbter | 83/36 X |
| 4,187,132 | 2/1980 | Dijk et al. | 226/10 X |
| 4,437,369 | 3/1984 | Brocklehurst et al. | 83/367 X |
| 4,493,234 | 1/1985 | Ziegler et al. | 83/367 X |

FOREIGN PATENT DOCUMENTS

| | | | |
|---|---|---|---|
| 521436 | 3/1931 | Fed. Rep. of Germany | 112/322 |
| 2653790 | 6/1978 | Fed. Rep. of Germany | 83/367 |

*Primary Examiner*—Wm. Carter Reynolds

*Attorney, Agent, or Firm*—Thomas & Kennedy

[57] ABSTRACT

Terry cloth toweling (18) moves from a supply along its length through an aligning and cutting system (14), to a transfer station (15). As the untufted bands (20) of the toweling material approach the transfer station, a plurality of fingers (28) of a gate (25) engage the untufted portion of the toweling, and as the toweling continues to move, the oncoming edge (22) of the plush surface (19) of the toweling engages and is retarded by the fingers. In the meantime, a plurality of presser feet (92) each of which is aligned with the fingers of the gate urge the toweling into engagement with a feed roller (85) that pulls the toweling through the processing path, and tension in the toweling tends to lift one or more of the presser feet (92) to relieve the pull applied to the toweling. This functions to straighten the band of the toweling. The toweling is then cut across its length with cutter (45), and the cut segment of towel in the transfer station (15) is then moved in a path parallel to its cut edges through a hemming station (16) where the cut edges are folded over and sewn by sewing machines (17).

12 Claims, 13 Drawing Figures

FIG. 2
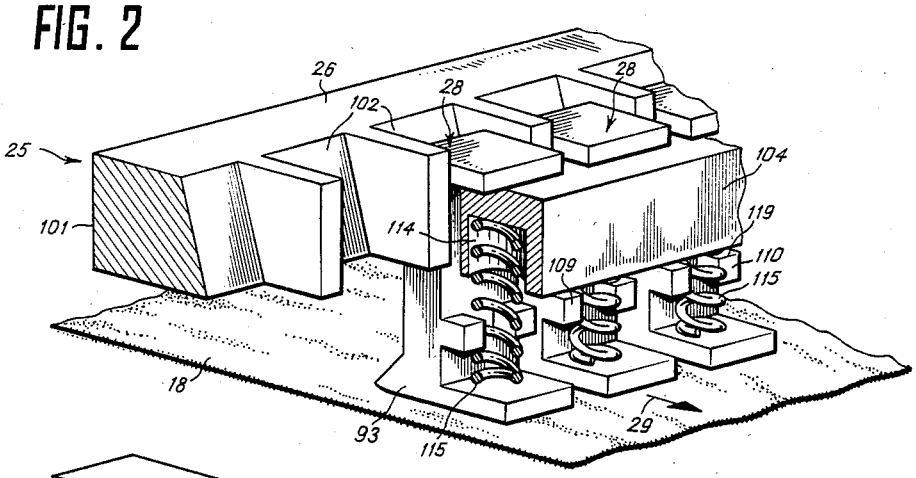
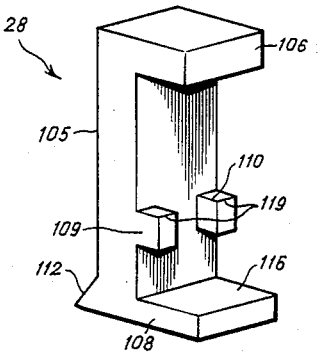
FIG. 3
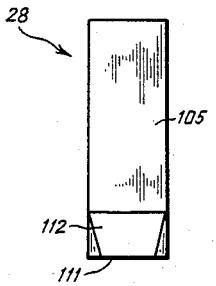
FIG. 4
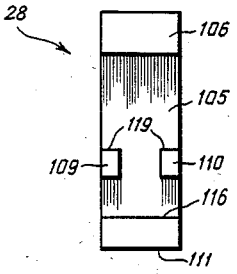
FIG. 5
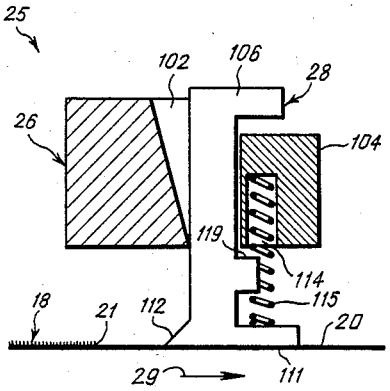
FIG. 6
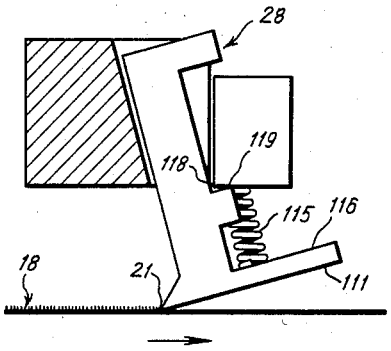
FIG. 7

TOWEL ALIGNING, CUTTING AND HEMMING SYSTEM

CROSS REFERENCE TO RELATED APPLICATION

This is a continuation-in part of U.S. patent application Ser. No. 621,935, filed June 18, 1984.

BACKGROUND OF THE INVENTION

This invention relates to a method and apparatus for automatically advancing sheet material such as terry cloth toweling along its length from a supply to a transfer station, cutting segments of the sheet material in the transfer station from the supply, then moving the cut segment of the sheet material in a path parallel to its cut ends, and hemming the cut ends as the sheet material moves. More particularly, the invention comprises a method and apparatus for aligning the untufted laterally-extending bands or hem spaces of terry cloth toweling as the toweling is moved from a supply toward a cut and transfer station, in such a manner that the untufted bands are straightened and accurate cuts are made through the bands at positions equidistance between the plush areas of the toweling.

In the manufacture of terry cloth towels and other flat goods, a common procedure is to move the tufted toweling along its length from a supply and to cut across its length to form the goods in segments. A popular design for terry cloth towels is to have the main body of the terry cloth towel include a plush tufted surface of terry cloth, and then at the opposite ends of the towel to have one or more bands of or hem spaces of untufted toweling which are of lesser thickness than the plush portion of the towel. The terry cloth toweling is initially manufactured in a very long length, and the supply of terry cloth toweling material is advanced along its length and cut through the untufted bands to form the individual towel segments. The cut untufted bands are later folded and sewn into a hem.

In the past a supply of terry cloth towel material has been cut into towel segments by hand, by a worker moving the towel material along a work surface, locating the thin bands of the towel material, and then cutting across the toweling through the bands. Typically, a motorized cutting implement is used which includes a rotatable cutting disk and the worker moves the implement along the thin bands of toweling material to cut the material. This is a slow operation, requires a skilled worker, and occasionally results in improper cuts being made in the toweling material. It is very difficult for the worker to cut exactly parallel to the filler threads of the material.

Another prior art apparatus for cutting terry cloth toweling material through the thin bands extending laterally across the material includes an automated cutter wherein the supply of towel material is fed toward a cutting station between a pair of parallel rotatable rollers that engage the plush surfaces of the toweling to move the toweling to the cutter. The spacing of the rollers is greater than the thickness of the thin bands of the toweling material, so that the rotation of the rollers will not move the toweling material when the thinner bands are between the rollers. When a thin band of the toweling material is detected, the rollers are operated to run in the reverse direction and the rollers move the thick part of the toweling backwards along the feed path until the thin portion of the material is located between the feed rollers. This locates the thin portions of the material at the cutting station, and a cut is made across the material at a predetermined distance from the feed rollers. While this type of equipment functions to make a cut through the thin bands of the towel material, the equipment operates at a relatively low speed and the direction of movement of the toweling material must be reversed during each cutting cycle, and the equipment does not work well on relatively thin terry cloth material. Moreover, some terry cloth material is likely to have a pattern of several thin bands extending across the material so that the towel segment which is cut from the material will have a design at opposite ends of alternating long and short bands of thin material. It is difficult for some of the prior art automatic towel cutting equipment to distinguish between the long and short thin bands in the toweling material so as to make the cut in the long thin band and not in a short thin band.

Another prior art towel cutting device comprises a detecting system for locating bands formed in the terry cloth material that include no filler threads so that when a cut is made through these thin bands of a toweling material, a towel with a loose fringe is formed. The detection equipment includes a feeler that tends to fall through the areas of towel material that have no filler threads so as to locate the proper portion of a towel material where the cut is to be made. The detector tends to accumulate thread, lint, and debris and to become inoperable after the system has been operated for some period of time. Also, the detection system has not proven to be 100% reliable in that slack in one edge portion of the towel caused by nonuniform weaving of the material tends to cause an incorrect cut across the material.

Another prior art apparatus is disclosed in U.S. Pat. No. 4,375,175, wherein toweling material is advanced along its length to a cutting station and the thin bands of a toweling material are detected at opposite edges of the toweling material. The cutter is then angled so as to correspond with the angle of the thin band across the toweling material, the toweling material is stretched taut across its length so as to tend to remove the curvature from the thin band, and then the cut is made at the angle of the thin band across the toweling material.

Another prior art apparatus is disclosed in U.S. Pat. No. 4,437,369 which discloses apparatus that advances toweling material along its length to a cutter. Detectors at opposite sides of the path of the toweling material detect the thin bands through which the cut is to be made, and the toweling material is advanced from the detectors at each edge independently of the opposite edge so that the opposite ends of the thin band of the toweling material will be properly located at the cutter. The toweling is stretched across its length so as to remove the curvature of the thin band before the cut is made.

Although it has been recognized in the prior art that it is desirable to straighten the thin bands of toweling material before cutting through the toweling material, the prior art does not teach a method for aligning the thin bands of toweling material not only at the opposite edges of the toweling material but at several positions across the length of the toweling material in a simple, reliable and expedient manner.

SUMMARY OF THE INVENTION

Briefly described, the present invention comprises an aligning, cutting and hemming system which is constructed and arranged to move a supply of sheet material, such as terry cloth toweling which includes bands of different character from the main body of the sheet material that extend across the length of the sheet material, to straighten the bands as the bands move to a cutting station so that an accurate cut can be made through the bands of the material. The toweling is cut through the thin bands of the toweling, and the cut segments are moved parallel to the cut ends and through a hemmer that folds and sews the cut ends.

The apparatus includes a feed roller and a presser foot assembly with a plurality of presser feet that are biased toward engagement with the feed roller. Each presser foot individually presses the toweling material into frictional engagement with the surface of the feed roll, so that rotation of the feed roll tends to pull the toweling material through the processing path. Each presser foot also extends beyond the feed roll toward the oncoming toweling material and includes an end portion that forms a depression in the plane of the toweling material.

In the meantime, as the thin band of material is pulled by the feed roll and presser feet from the supply toward the cutting station a plurality of fingers of a gate assembly move into engagement with the thin band of toweling material. When the oncoming edge of the plush segment of toweling material reaches the fingers of the gate, each finger tends to stop the oncoming edge and therefore create tension in the portion of the toweling extending in a line from each finger to the feed roll. The tension in the toweling material tends to remove the depressions in the toweling material and lift each presser foot away from the feed roll, thereby relieving the moving force applied to the toweling material by the feed roll. Should the thin band of toweling material not be straight, the fingers of the gate will engage the oncoming edge of a plush segment of the material at different times, so that the presser feet will lift individually, not all at once away from the feed roll. This action tends to progressively relieve the pulling force applied by the feed roll and presser feet and to straighten the thin band of the toweling and stop the movement of the toweling at the cutting station.

After the toweling has been straightened it is cut through at its thin band and the cut segment of toweling is then moved from the transfer station along a path parallel to the cut edges of the cut setment, and the cut edges are folded over and sewn into a hem as the segment moves away from a transfer station.

Thus, it is an object of this invention to provide a sheet material aligning, cutting and hemming system wherein sheet material having bands extending across its length of a different character than the main body of the sheet material is advanced toward a cutting station and the bands approaching the cutting station are detected at several positions extending across the path, and in response to the detection the band is straightened by slowing the movement at those positions of the sheet material where a portion of the band leads another portion of the band.

Another object of this invention is to provide a sheet material aligning method and apparatus which straightens a band of the sheet material at a cutting station by engaging and pulling the sheet material at several positions across the sheet material, and terminating the pull on each portion of the sheet material in response to the detection of the band advancing to the correct position at the cutting station.

Another object of this invention is to provide a method and apparatus for cutting sheet material such as terry cloth towel having bands of different thicknesses extending across the material, which apparatus is reliable over prolonged operational periods to accurately cut the sheet material into lengths that correspond to the positions of the bands extending across the sheet material.

Another object of this invention is to provide a feeding and alignment method and apparatus which reliably moves sheet material such as terry cloth toweling having laterally extending bands through an operating station and which straightens the bands of the sheet material as the material moves into the operating station so that the sheet material can be accurately cut across its length or otherwise treated in the operating station with its bands straight.

Another object of this invention is to provide a mechanism for straightening the thin bands of terry cloth toweling by urging the toweling along its length at a plurality of positions arranged across the length of the toweling, and retarding at a plurality of positions arranged across the toweling the oncoming edge of the plush surface of the toweling, and in response to the retarding at each position, terminating the urging of the toweling at a position aligned along the toweling from the position where the oncoming edge is retarded.

Other objects, features and advantages of the present invention will become apparent upon reading the following specification, when taken in conjunction with the accompanying drawings.

BRIEF DESCRIPTION OF THE DRAWINGS

FIG. 2 is a detailed perspective illustration of the gate mechanism, with portions removed to show how the holding fingers are mounted in the support bar.

FIG. 3 is a perspective illustration of a holding finger.

FIG. 4 is a front elevational view of a holding finger.

FIG. 5 is a back elevational view of a holding finger.

FIG. 6 is a side elevational view of the gate mechanism when the holding fingers are in flat abutment with a thin band of the toweling.

FIG. 7 is a schematic illustration of a holding finger when it is wedged against the oncoming edge of the plush portion of the toweling.

DETAILED DESCRIPTION

Figure 1:
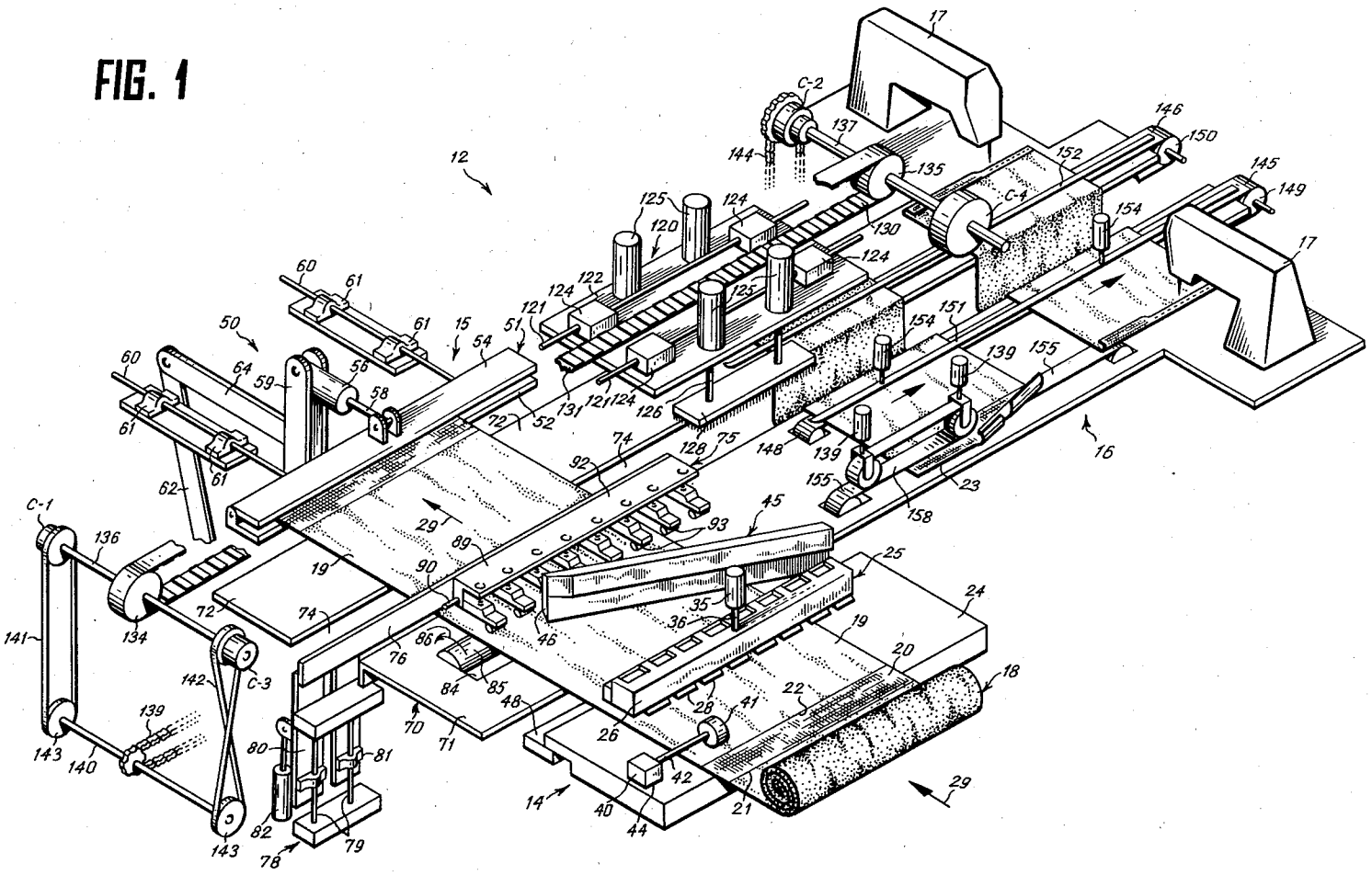
FIG. 1 is a perspective illustration of the automatic aligning, cutting and hemming apparatus, showing the operating elements of the apparatus without the various supports and the drive mechanisms.

Referring now in more detail to the drawings, in which like numerals indicate like parts throughout the several views, FIG. 1 illustrates the automatic aligning, cutting and hemming apparatus 12 which includes an aligning and cutting station 14, a transfer station 15, a hemming station 16 and sewing machines 17. A length of toweling material 18 or other sheet material is moved from a supply along a path through the aligning and cutting station 14 to the transfer station 15. The towel material is cut across its length at cutting station 14 and the cut segment in transfer station 15 is subsequently moved parallel to its cut ends through the hemming station 16 to sewing machines 17. The toweling material includes a plush terry cloth surface 19 and thin bands 20 extend laterally across the toweling. The cuts in the toweling material are to be made through the thin bands 20 equidistant between the leading and trailing edges 21 and 22 of the plush segments.

As the toweling moves through aligning and cutting station 14, it passes over work table 24 and beneath gate 25. Gate 25 comprises a support arm 26 with a plurality of holding fingers 28 mounted in the support arm. Pneumatic cylinder 35 is schematically illustrated as having its cylinder rod 36 attached to support arm 26, and operation of cylinder 35 causes the support arm 26 to reciprocate toward and away from toweling 18 so that the holding fingers 28 slide on the surface of the toweling.

Band sensor 40 is also mounted on work table 24 and includes a roller 41 with its axle 42 extending from a housing 44. The axle 42 and roller 41 are spring biased toward engagement with the moving toweling material, and when a thin band 20 of a toweling material passes beneath roller 41, the roller moves downwardly and after the thin band passes from beneath the roller, the roller moves back up on to the upper surface of the plush segment of the terrycloth toweling. With this arrangement, band sensor is able to sense the movement of a thin band 20 through the alignment and cutting station 14. If the toweling material is of the type that has several bands of different dimensions between large segments of plush material, the sensor can be set so that it will ignore the small bands and detect only the larger bands. With this arrangement, it is only the larger bands that will be cut, in the manner hereinafter described.

Cutter 45 is positioned at the edge of work table 24 and is arranged to cut through the toweling material 18. Cutter 45 includes a movable blade 46 located above the path of travel of the toweling and a stationary element 48 below the path. The blade 46 moves by actuation of a clutch/brake motor and connecting arm (not shown) back and forth with a scissors like motion with respect to stationary elements 48 so as to cut the toweling.

Stationary element 48 and work table 24 are arranged with a lost motion connection, whereby work table 24 and the gate 25 carried thereby can be moved toward and away from stationary element 48 of cutter 45. The reciprocation of work table 25 is caused by pneumatic cylinder 49 (FIGS. 8–11), and the position and movement of work table 24 is controlled by appropriate guides (not show). With this arrangement, when a cut is made by cutter 45 through toweling material 18, and the cut edge of the toweling material is positioned at the edge of stationary element 48 of cutter 45, the work table 24 is moved along the path so that the cut edge of the portion of the toweling material extending back toward the supply is projected a short distance beyond the edge of stationary element 48, thereby presenting an edge of material that can be grasped and pulled on into transfer station 15.

Figure 8:
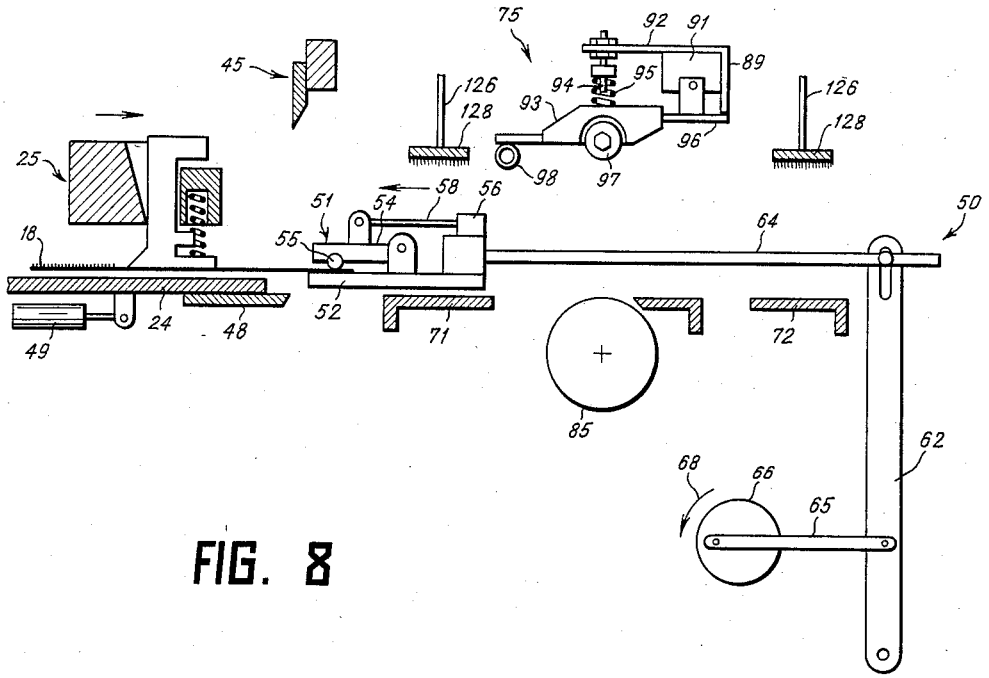
FIG. 8 is a side detail illustration of the presser foot assembly in its raised position, the feed roll and the gate, showing the toweling material as it is about to be threaded from the presser foot assembly over the feed roll.

As illustrated in FIGS. 1 and 8, draw out mechanism 50 is mounted on the other side of transfer station 15 from aligning and cutting station 14 and includes jaws 51 that are movable back and forth over the transfer station to grasp the previously cut edge portion of the toweling material and to pull the supply of material on into the transfer station. Jaws 51 include lower jaw 52 and upper jaw 54, with upper jaw 54 being pivotally mounted to lower jaw 52. A resilient strip of material 55 is applied to the inner surface of the upper jaw 54 so that the jaw makes frictional engagement with the toweling. Pneumatic cylinder 56 has its rod 58 attached to upper jaw 54, and the jaws 51 open and close in response to the movement of the cylinder rod 58.

Figure 9:
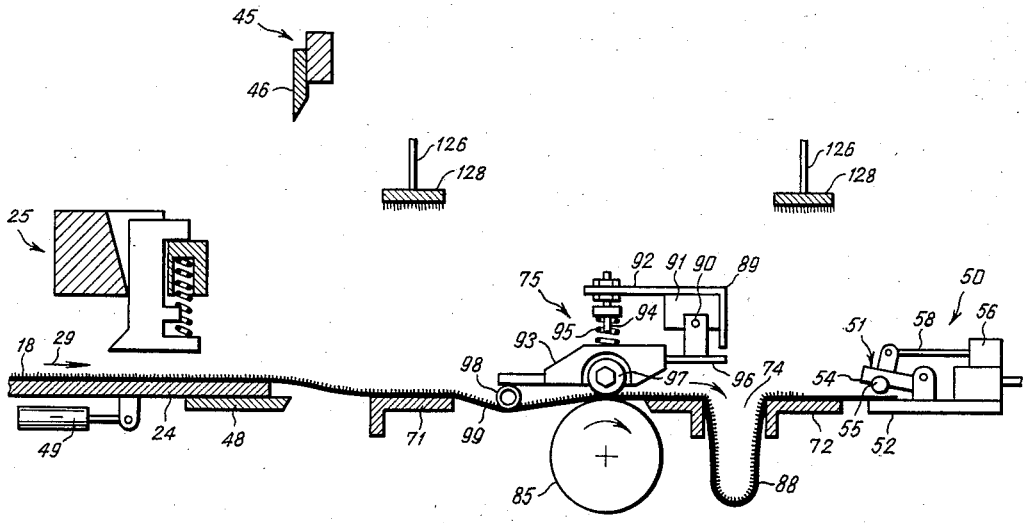
FIG. 9 is a side detail illustration, similar to FIG. 8, but showing the presser foot assembly in its lowered position and the toweling being drawn into the system with the feed roll.

As illustrated in FIG. 1, lower jaw 52 of draw out mechanism 50 is supported on a pair of parallel, horizontally extending slide bars 60. Slide bars 60 are each mounted in bearings 61 and are supported by the framework of the apparatus, so that the slide bars pass axially through the bearings. Lever 62 is pivotally mounted to the frame work at its lower end, and its upper end is connected to one end of link 64. Link 64 is connected at its other end to lower jaw 52. As shown in FIG. 8, crank arm 65 is connected at one of its ends to a midpoint of lever 62 and is connected at its other end to fly wheel 66. Fly wheel 66 is rotated about its center axis by a clutch/brake motor (not shown). With this arrangement, rotation of fly wheel 66 as indicated by arrow 68 causes jaws 51 of draw out mechanism 50 to reciprocate back and forth across transfer station 15, from immediately adjacent cutter 45 (FIG. 8) to a position where the jaws will have pulled the leading edge portion of the toweling material across the transfer station (FIG. 9). The jaws 51 are closed about the protruding edge portion of the previously cut toweling material, and then the jaws pull the toweling material to stretch it across the transfer station 15.

As illustrated in FIG. 1, a work table 70 extends from transfer station 15 through hemming station 16, with the work table 70 being formed in halves with one segment 71 located adjacent aligning and cutting station 14 and the other segment 72 located further away from aligning and cutting station 14. A gap 74 is formed between work table segments 71 and 72.

As further illustrated in FIG. 1, presser foot assembly 75 is located over work table 70. Presser foot assembly 75 is mounted to cantilever support arm 76, and cantilever support arm 76 is mounted at one end to elevator assembly 78. Elevator assembly 78 comprises a pair of upright slide bars 79 and a movable support frame 80 is slidably mounted to slide bar 79 by bearings 81. Pneumatic cylinder 82 functions to reciprocate support frame 80 on slide bars 79 so that presser foot assembly 75 can be raised and lowered with respect to the upper surface of work table 70.

As illustrated in FIG. 1, segment 71 of work table 70 has a slot 84 formed therein, and feed roll 85 is positioned so that it protrudes upwardly into slot 84. Feed roll 85 is rotatable about its longitudinal axis in the direction as indicated by arrow 86. Feed roll 85 and presser foot assembly 75 are positioned in vertical alignment with one another, so that when presser foot assembly 75 is moved down toward the plane of work table 70 it acts as a biasing means for urging the toweling material into engagement with feed roll 85, and the rotation of feed roll 85 will apply enough friction to the toweling material so that the feed roll acts as a feed means to draw the toweling material further onto work table 70. This tends to form a loop 88 (FIGS. 9–11) in the toweling material on the other side of the feed roll that protrudes down into the gap 74 between the segments 71 and 72 of the work table 70.

As illustrated in FIGS. 1 and 8–10, the presser foot assembly 75 comprises a support frame 89 having a laterally-extending axle 90 extending through a pair of side frame elements 91 and an upper laterally extending spring support plate 92. A plurality of presser feet 93 are pivotably mounted to axle 90 and extend laterally out from axle 90 beneath upper spring support plate 91. Pins 94 are vertically mounted in spring support plate 92, with each pin positioned over a presser foot 93. A coil compression spring 95 surrounds each pin 94 and its upper and lower ends bear against spring support plate 92 and a presser foot 93 and the spring tends to spring-bias its presser foot 93 downwardly away from spring plate 92 about axle 90 until the plate 96 at the rear of the presser foot engages the support frame (FIG. 8) or until the roller 97 of the presser foot engages feed roll or the toweling extending over the feed roll (FIG. 9). The distal end of each presser foot has a downwardly extending rounded protrusion formed by a section 98 of tubing.

The presser foot assembly 75 is arranged with respect to feed roll 85 so that the roller 97 of each presser foot 93 is located over feed roll 85 and is spring-biased toward engagement with feed roll 85 when the presser foot assembly is in its lowered position (FIG. 9). The rounded end portion 98 of each presser foot is positioned laterally away from the feed roll 85 toward gate 25 and is spring-biased downwardly into engagement with the toweling material (FIG. 9) and tends to form a depression 99 in the toweling material (FIG. 9). As illustrated in FIG. 9, when there is little tension in the toweling material 18 extending from gate 25 to feed roll 85, the presser feet 93 will be urged downwardly by coil compression springs 95 so that the rollers 97 of the presser feet urge the toweling material into frictional engagement with feed roll 85, whereby the feed roll will pull the toweling material from gate 25 on into the gap 74 of the work table. However, if there is tension in the toweling material 18 sufficient to remove the slack in the toweling that extends to a presser foot 92 (FIG. 10), the presser feet 93 which are applied to the taut portions of the toweling will be lifted by the tension in the toweling so that the rollers 97 of the presser feet will not press the toweling material into frictional engagement with the feed roll 85, whereupon no feeding of this portion of the toweling material will be caused by the feed roll 85.

As illustrated in FIGS. 2–7, gate 25 includes support arm 26 that extends in a horizontal attitude laterally across the path 29 of the toweling 18. Support arm 26 includes a front surface 101 that faces the oncoming toweling 18 and rear surface that is formed with a plurality of slots 102 that face in the direction of movement of the toweling. A holding finger 28 is mounted in each slot, and retaining bar 104 extends across all of the slots 102 and holds the fingers 28 in the slots.

As illustrated in FIGS. 3–5, each holding finger 28 includes stem 105, upper overhang 106, lower foot 108, and spaced protrusions 109 and 110. Foot 108 includes a flat, smooth bottom surface 111 and downwardly sloped nose 112 that intersects the flat bottom surface. A series of spring bores 114 are formed in the lower surface of retaining bar 104, with each spring bore being aligned with a slot 102 of the support arm 26.

When the holding fingers 28 are mounted to the support arm 26, springs 115 are extended into the spring bores 114 of retaining bar 104, the holding fingers 28 positioned about the retaining bar 104 with the spring bearing against the upper surface 116 of each foot 108, and then the retaining bar is rigidly mounted to the support arm by means of screws, etc. The upper overhang 106 of each retaining finger 28 supports the retaining fingers when the support arm 26 is suspended above the work table 24.

As illustrated in FIG. 6, when the support arm 26 of the gate 25 is lowered so that its holding fingers 28 engage the thin band 20 of toweling 18, the flat, smooth bottom surface 111 of each holding finger 26 will be pressed by spring 115 into flat engagement with the upper, flat surface of the toweling. When the support arm 26 is lowered to the position of FIG. 6, it will be lowered a distance such that the upper overhang 106 will no longer engage the top surface of retaining bar 104, so that the spring 114 will be compressed as the holding fingers 28 move telescopically with respect to support arm 26.

When the oncoming leading edge 21 of the toweling 18 engages the downwardly sloped nose 112 of one or more of the holding fingers 28, the engaged holding fingers will tend to pivot in the support arm 26 (FIG. 7) by the force applied by the leading edge 21 against the nose 112. Spring 115 tends to maintain the holding finger 28 against the toweling 18, and as the nose 112 is moved with the toweling, the finger tends to slide upwardly as it pivots about the lower inner edge 118 of retaining bar 104. The pivoting continues until the upper rear edges 119 of the spaced protrusions 109 and 110 engage the lower surface of retaining bar 104. Although FIG. 7 exaggerates the degree of tilt of the holding finger 28, the holding finger usually tilts from 10° to 12° before it becomes wedged between retaining bar 104 and the oncoming edge 21 of the plush surface of the toweling 18.

Each holding finger 28 operates independently of the other holding fingers. Should some of the holding fingers become pivoted and locked against the oncoming edge 21 of the toweling before other holding fingers lock against the oncoming edge, there sometimes is a tendency for the support arm 26 to rise slightly from the force applied to it by the locked holding fingers 28. In the meantime, the untilted holding fingers remain firmly applied to the toweling 18 in flat sliding relationship (FIG. 6) because of the ability of each finger to independently telescope with respect to support arm 26. This avoids premature tilting of the fingers.

When the support arm 26 is lifted away from the upper surface of the toweling 18 so that the holding fingers 28 no longer engage the toweling, the springs 115 tend to pivot the holding fingers back to an upright attitude. It will be noted that the lower ends of springs 115 engage the foot 108 of the holding finger 28 at a position intermediate its nose 112 and its rear surface. This tends to apply the flat, smooth bottom surface 111 evenly to the upper surface of the toweling, so that the nose 112 does not tend to gouge downwardly into the toweling, and so that the nose 112 does not tend to ride up over the oncoming edge of the plush portion of the toweling.

Figure 12:
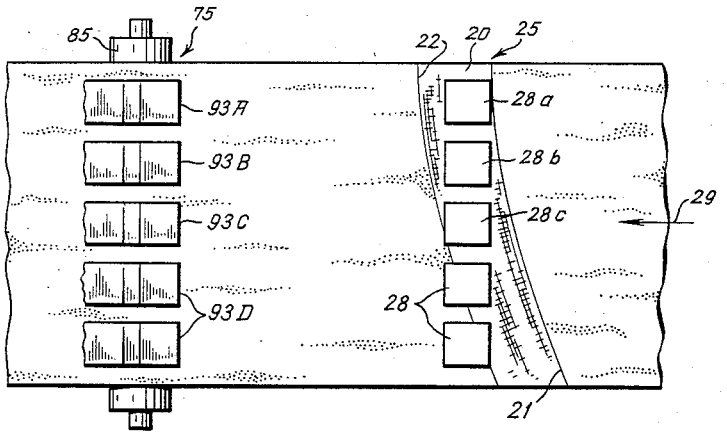
FIG. 12 is a schematic plan view of the presser foot assembly and the fingers of the gate, demonstrating how a thin band of the toweling material might approach and be engaged by the fingers of the gate.

As illustrated in FIGS. 1 and 12, there is one presser foot 93 in the presser foot assembly 75 for each of the holding fingers 28 of the gate 25, and each presser foot 93 is aligned with a holding finger 28. When gate 25 is moved to its down position so that the lower surfaces 111 of the fingers 28 engage the thin band 20 formed in the toweling, and when the presser foot assembly 75 has been moved to its lowered position so that its presser feet 93 engage the toweling and urge the toweling into frictional contact with the feed roll 85, the feed roll will draw the toweling through the gate and feed the toweling to the gap 74 in the work table. If the relatively thin band 20 in the toweling is not straight so that one portion of the band leads another portion (FIG. 12), the leading portion of the oncoming edge 21 of the plush segment of the toweling will reach its holding finger 28 before the other trailing edge portions.

Figure 10:
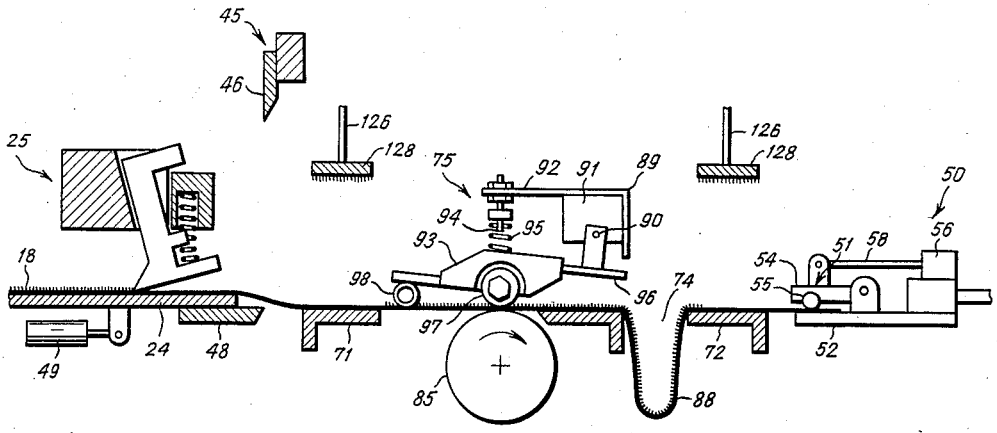
FIG. 10 is a side detail illustration similar to FIG. 8, showing the presser foot assembly, feed roll and gate, but showing how one of the fingers of the gate tends to stop the oncoming edge of the plush portion of the toweling material so as to stretch the toweling material from the gate to the feed roll and how the presser foot is lifted by the towel away from engagement against the feed roll.
Figure 11:
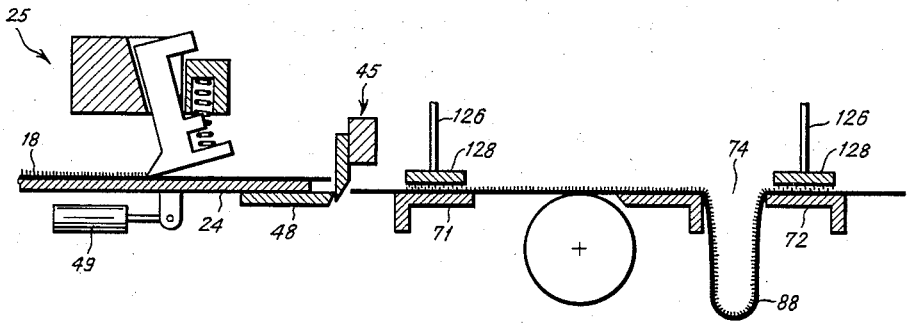
FIG. 11 is a side detail illustration, similar to FIG. 8, showing the toweling having been cut and the cut segment being moved by the transfer trolly to the hemmer.

For example, FIG. 12 illustrates finger 28A as having already engaged the oncoming edge 21 of the plush segment of the toweling while the remaining fingers 28B, 28C, etc., have not yet been engaged by the oncoming edge 21. Therefore, finger 28A of gate 25 will tend to stop the movement of the portion of the oncoming edge that it engages, while the remaining portion of the oncoming edge is uninhibited. This tends to form tension in the toweling that extends between holding finger 28A and its corresponding presser foot 93A, while similar tension is not created in the portions of the toweling extending between the other fingers 28B, 28C, etc., and their corresponding presser feet 93B, 93C, etc. Therefore, the span of the toweling between finger 28A and presser foot 93A will become taut as the feed roll continues to rotate, and eventually the presser foot 93A will move from its position as illustrated in FIG. 9 to the position as illustrated in FIG. 10, where the tension in that span of the toweling lifts the presser foot away from feed roll 85. Therefore, the span of toweling between finger 28A and presser foot 93 will no longer be pulled by feed roll 85, whereas the remaining portions of the toweling will continue to be pulled on into gate 25 by the other presser feet 93B, etc.

As each holding finger of the gate 25 engages the oncoming edge of the plush segment of the toweling, a similar result is generated, whereby the fingers 28 stop the movement of the towel while the feed roll 85 continues to pull on the towel, until the span of the toweling between each finger and its aligned presser foot becomes taut and lifts the presser foot, to terminate the pulling action by the feed roll. In this manner, the oncoming edge 21 of the plush segment of the toweling 18 will be properly aligned at the gate 25. When the material is to resume its movement the entire gate will be lifted away from the surface of the toweling by pneumatic cylinder 35, thereby releasing the toweling.

It will be noted from FIGS. 3 and 4 that the leading edge 21 of the plush surface of the toweling presents only a small surface against which the holding fingers 28 can engage; however, since most toweling is double-faced, the fingers 28 tend to push the thin band against the surface of the work table 24, and the oncoming edge of the double-faced plush surfaces forms a relatively large ledge against which the fingers work. Moreover, the presser foot assembly 75 functions to magnify the effect of the relatively small oncoming edge of the plush segment of the toweling, in that when the deep U-shape 99 formed by the presser feet in the moving toweling is straightened, the toweling lifts from its slack position to its taut position through a distance that is much greater than the height of the plush surface of the toweling. This assists in lifting the flat portion of each presser foot away from the feed roll 85. The distance from rounded protrusion at one end of the presser foot 93 to the axle 90 provides a leverage whereby a relatively small lifting force against the rounded protrusion will lift the presser foot away from feed roll 85.

As illustrated in FIGS. 1 and 6–8, transfer trolley 120 is mounted on a pair of parallel, horizontal slide bars 121 that extend from over transfer station 15 toward hemming station 16. Transfer trolley 120 comprises a support plate 122, slide blocks 124 mounted to the upper surface of support plate 122, with the slide blocks surrounding the slide bars 121 and supporting the plate from the slide bars. Four pneumatic cylinders 125 are mounted to support plate 122, with the cylinder rods 126 protruding downwardly through the support plate toward work table 70. A foot element 128 is mountd to the lower end of each cylinder rod 126. Timing belt 130 has its lower flight 131 attached to the upper surface of support plate 122 of transfer trolley 120. Timing belt 130 extends about sheaves 134 and 135 (FIG. 1), and 137, respectively. Drive axles 136 and 137 each have clutches mounted thereon, with clutches C-1 and C-3 mounted on axle 116 and with clutches C-2 and C-4 mounted on drive axle 137. Drive chain 139 is driven by a motor (not shown), and rotates lower drive axle 140. Drive belts 141 and 142 extend from sheaves 143 mounted on lower drive axle 140 and about the sheaves of the clutch brakes C-1 and C-3 on the upper drive axle 136, with one belt 142 being criss-crossed so as to drive the upper drive axle 136 in the opposite direction. The motor that drives chain 139 operates through a gear box to drive the chain at a high velocity, so that upper drive axle 136 operates at a high velocity to move timing belt at a high rate of speed, approximately 450 feet per minute.

Clutch C-2 at the drive axle 137 is driven by chain 144, and chain 144 is driven by the motor (not shown) that drives sewing machines 17. When drive axle 137 is rotated by clutch C-2, it is driven at a relatively slow speed, and causes timing belt 130 to move at approximately 50 feet per minute. Clutch C-4, which is mounted to the opposite end of drive axle 137, functions as a brake and simply stops the rotation of drive axle 137 and timing belt 120.

The arrangement of clutches C-1, C-2, C-3, and C-4 which are mounted to drive axles 136 and 137 are such that when clutch C-1 is engaged, the lower flight of timing belt 130 and transfer trolley 120 are driven at a relatively high speed from above transfer station 15 toward hemming station 16. As the transfer trolley approaches hemming station 16, clutch C-1 is disengaged and clutch C-2 engages. This causes the timing belt 130 and transfer trolley 120 to continue to move in the same direction but to be driven at the slower speed that corresponds to the speed of operation of the sewing machines 17. When the transfer trolley has been driven its full length toward sewing machines 17, clutch C-2 disengages and clutch C-3 engages. Clutch C-3 then moves the timing belt 130 and transfer trolley 120 in the reverse direction at a high velocity until the transfer trolley approaches its start position, whereupon clutch C-3 disengages and clutch C-4 engages. Clutch C-4 functions as a brake to stop the movement of the timing belt and transfer trolley.

When transfer trolley 120 is to be driven from left to right in FIG. 1, from transfer station 15 toward hemming station 16, the upright cylinders 125 carried by the transfer trolley are operated to move their feet 128 downwardly toward the segment of the previously cut towel present on the work table, so that the feet engage the towel. The subsequent movement of the transfer trolley tends to cause the feet to drag the towel on the work table from the transfer station, parallel to the cut edges of the towel, on into the hemming station 16. When the transfer trolley has moved the towel into the hemming station, the feet 108 are retracted by the cylinders 105 and the transfer trolley is moved back to its start position.

The hemming station 16 includes sewing machines 17 located on opposite sides of the gap 74 of the work table 70 a pair of carrier belts 145 and 146 which have upper flights that move upwardly through openings such as opening 148 in work table segment 71 and move through the hemming station and about a sheave 149 and 150, and then return beneath the work table segments. Presser bars 151 and 152 are positioned over carrier belts 145 and 146 and are movable toward and away from the carrier belts by means of pneumatic cylinders, such as cylinders 154 for presser bar 151. When the transfer trolley 120 approaches carrier belts 145 and 146, the cylinders 154 lift the presser bars 151 and 152 so that the oncoming towel segment carried by the transfer trolley moves onto the carrier belts at a high rate of speed. When the transfer trolley slows down, the cylinders 154 lower the presser bars 151 and 152, so that the relatively smooth presser bars urge the oncoming towel into frictional contact with the carrier belts 145 and 146. Transfer belts 145 and 146 move at a linear velocity compatible with the operation of sewing machine 17.

Hemmer belts 155 are positioned adjacent the opposite edges of work table segments 71 and 72 at hemming staion 16. Each hemmer belt 155 (only one being shown) carries the cut edge of the towel segment through the hemming station. An upper clamping belt 158 is located over each hemmer belt 155. The upper clamping belt is an idler belt and is driven by frictional contact with the lower hemmer belt. The upper clamping belt 158 is movable up and down by pneumatic cylinders 139. When the transfer trolley 120 moves a towel segment onto the hemmer belts 155, the upper clamping belts 138 are lifted away from the lower hemmer belt until the towel is at least partially received on the lower hemmer belt, whereupon the upper clamping belts are lowered so as to make positive contact with the previously cut edge portion 23 of the towel segment. Thus, the cut edges of the towel segment are positively controlled as they move on into the sewing machine 17.

The hemmer belts 155 are the type that can be folded over upon themselves as they fold and form the hem of the toweling material. Examples of hemmers suitable for use with this system are described in more detail in U.S. Pat. Nos. 3,772,948 and 3,906,878.

Figure 13:
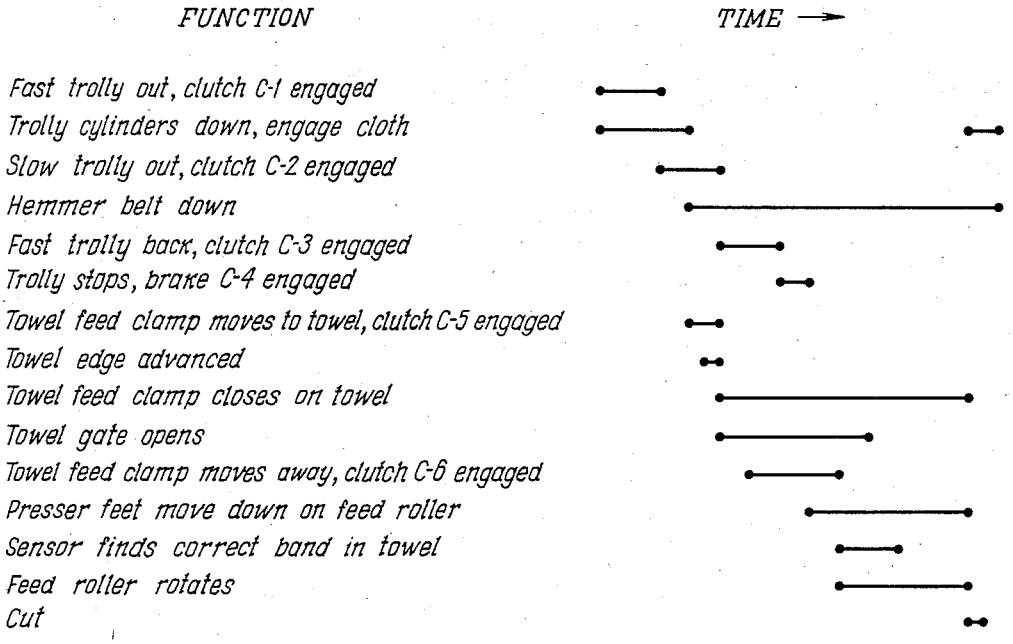
FIG. 13 is a time diagram which illustrates the function of the various elements of the automatic towel aligning, cutting and hemming system.

FIG. 13 is a timing diagram of the system, showing the approximate sequence and duration of operation of the various clutches, cylinders and other features of the system.

OPERATION

When the automatic towel aligning, cutting and hemming system is to begin a cycle of operation, a towel has just been cut, and the transfer trolley 120 has its cylinders 125 distended (FIG. 11) so that each of the cylinders engage the previously cut towel segment. The clutch C-1 (FIG. 1). is engaged and fuctions to move the transfer trolley rapidly from the transfer station 15 on into the hemming station 16 causing the cut towel segment to slide along the work table. The loop 88 in the cut segment tends to ride along in slot 74 which extends entirely from transfer station 15 on through hemming station 16. As the transfer trolley approaches the hemming station, clutch C-1 disengages and clutch C-2 engages, causing the transfer trolley to move at a slower speed that is compatible with the operation of sewing machines 17.

The towel segment is then moved onto carrier belts 145 and 146 and onto hemmer belts 155, and presser bars 151 move down into engagement with the towel segment and upper clamping belts 158 similarly move down into clamping engagement with the towel segment. After the presser bars 151, 152 and upper clamping belts 158 have engaged the towel segment, the feet of the transfer trolley are retracted upwardly, clutch C-2 disengages and clutch C-3 engages, causing the transfer trolley to move rapidly back to its start position.

As the transfer trolley reaches its start position, clutch C-3 disengages and clutch C-4 engages, thereby braking the trolley to its start position. In the meantime, the cut segment of toweling material is carried on through the hemming station, its previously cut ends are folded over and sewn together by sewing machines 17.

In the meantime, draw out mechanism 50 will begin its movement across transfer station 15 just as soon as transfer trolley has cleared the transfer station. Draw out mechanism 50 moves from the position illustrated in FIGS. 9 and 10 toward cutter 45 with its jaws 51, 52 in their open position. Just as the jaws reach the previously cut edge of the supply of toweling material, cylinder 49 of work table 24 causes the work table to move toward the oncoming jaws. This is illustrated in FIG. 8. This pushes the previously cut edge of the toweling material beyond the stationary element 48 of the cutter 45, thereby presenting an edge of the toweling material that can be grasped by the jaws. When the jaws reach the toweling material, the jaws clench the previously cut edge portion of the toweling material, and the draw out mechanism then begins to move in the opposite direction to draw the supply of toweling material out into the transfer station 15.

As illustrated in FIG. 9, when the jaws reach their start position, the toweling material will have been drawn from the supply through the gate 25 through the cutter 45, across the transfer station 15 so that the previously cut edge of the toweling material extends slightly beyond the far edge of the work table 72. Now that the draw out mechanism 50 has cleared the work table (FIG. 9), presser foot assembly 75 is moved from its up position (FIG. 8) to its down position (FIG. 9) until its presser feet press the toweling down into engagement with the feed roll 85. As the feed roll rotates, it draws more toweling material from a supply through gate 25 and cutter 45 with a loop 88 being formed in the toweling material behind the feed roll. When the roller 41 (FIG. 1) of the band sensor 40 detects a thin band in the toweling material of the correct length, cylinder 35 of gate 25 will cause the gate to be lowered and its fingers 28 will engage the thin band.

As the oncoming edge 21 of the plush segment of the toweling material engages the fingers 28 of the gate 25, tension will be applied to the segment of toweling material extending between the gate 25 and feed roll 85, whereupon the distal end portions 98 of the presser feet 93 function as relief means to raise the presser feet and relieve the force applied by the presser feet against the feed roll and the presser feet 93 will be pivoted from their positions illustrated in FIG. 9 to their positions as illustrated in FIG. 10.

As illustrated in FIG. 12, if one portion of the thin band 20 leads another portion, the fingers 28 of the gate 25 will engage the oncoming edge of the plush surface of the toweling at different times and the corresponding presser feet will lift individually at different times away from the feed roll, causing earlier release of the pulling force on that portion of the toweling that is too far ahead, which results in the band 20 being straightened at the gate 25. Thus, the fingers 28 of gate 25 function as detecting means positioned up the path from the feed roll for detecting the movement of the band at intervals across the toweling as the band approaches the feed roll.

Once the band has been straightened and positioned at the gate, cutting blade 45 is pivoted downwardly to cut across the toweling. The relative positions of the cutter 45 and the gate 25 are adjustable so that the cut will be made equal distance between the trailing 22 and leading 21 edges of the plush segments of the towel, directly through the thin band 20 of the toweling material. In the meantime, the feet 128 of transfer trolley 120 will have been lowered into engagement with the segment of toweling extending across the transfer station and the jaws 51 will have been opened. This places the now cut segment of toweling in control of the transfer trolley 120 and the cycle is repeated.

While this invention has been described in connection with terry cloth toweling, it should be understood by those skilled in the art that various other types of sheet material can be handled by the system as may be desired. Also, while the towel alignment mechanism has been disclosed in combination with a towel cutter, the alignment mechanism can be used in combination with various other equipment, such as drying and dying equipment.

While this invention has been described in detail with particular reference to a preferred embodiment thereof, it will be understood that variations and modifications can be effected within the spirit and scope of the invention as described hereinbefore and as defined in the appended claims.

I claim:

1. A method of forming the leading edge of the plush portion of uncut toweling and the like comprising advancing the toweling along its length through a predetermined path on a work surface with the leading edge of the plush portion extending across the path, engaging the portion of the toweling opposite the work surface ahead of the edge of a plush portion of the toweling with a plurality of independently movable holding fingers with flat portions of the holding fingers flat engagement with the toweling, in response to each finger engaging the oncoming leading edge of the plush portion of the toweling tilting each finger as it engages the leading edge of the plush portion of the toweling into wedged engagement with the toweling, and retarding the movement of the toweling with the tilted holding fingers.

2. The method of claim 1 and further including the step of maintaining the fingers that have not engaged the oncoming edge of the plush portion of the toweling in flat engagement with the toweling as others of the fingers individually engage the oncoming leading edge of the plush portion of the toweling and tilt into wedged engagement with the toweling.

3. The method of claim 1 and wherein the step of engaging the portion of the toweling ahead of the plush portion of the toweling with a plurality of independently movable holding fingers comprises supporting a plurality of said holding fingers in alignment with one another above the path of the toweling in telescopic relationship in a support member, moving the support member toward the hem space of the toweling until the fingers engage the hem space and move telescopically with respect to said support member.

4. The method of claim 1 and further including the step of independently biasing each holding finger toward the toweling when the flat portions of the holding fingers are in flat engagement with the toweling.

5. The method of claim 3 and wherein the step of tilting each finger into wedged engagement with the toweling comprises tilting each finger with the oncoming leading edge of the plush portion of the towel until the tilting of the finger is restrained by the finger support member.

6. The method of claim 1 and wherein the step of advancing the toweling along its length comprises pressing the toweling into engagment with a feed roll at a position behind the holding fingers with a plurality of presser members each aligned along the length of the toweling with a holding finger, rotating the feed roll to pull the toweling along its path, and in response to each holding finger retarding the movement of the toweling relieving the pressing of the toweling into engagement with the feed roll by the presser member in alignment with the aligned holding finger.

7. The method of claim 6 and wherein the step of pressing the toweling into engagment with the feed roll with a plurality of presser members comprises urging the toweling with a plurality of rollers toward engagement with the feed roll and rotating the rollers in response to the movement of the toweling past the rollers.

8. The method of claim 6 and wherein the step of pressing the toweling into engagement with the feed roll by a plurality of presser members comprises engaging the toweling with each presser member at the feed roll and also at a position between the feed roll and the holding fingers to form a depression in the length of toweling extending between the holding fingers and the feed roll, and wherein the step of relieving the pressing of the toweling into engagment with the feed roll by the presser members comprises stretching the toweling as the holding fingers retard the movement of the toweling so as to remove the depression in the toweling and move the presser members away from the feed roll.

9. Apparatus for forming the leading edge of the plush portion of uncut toweling and the like comprising a support arm, a plurality of holding fingers independently telescopically and pivotably mounted to said support arm, each of said fingers including a smooth flat surface for flat engagement with the surface of toweling, said support arm including means for limiting the pivotable movement of said holding fingers, means for moving said support arm toward and away from the toweling moving along a path to urge the holding fingers into engagement with the toweling, whereby the smooth flat surfaces of the holding fingers engage the toweling until the leading edge of a plush portion of the toweling engages the holding fingers whereupon the holding fingers pivot and wedge against the leading edge of the plush portion of the toweling and retard the movement of the toweling.

10. The apparatus of claim 9 and further including spring means for urging the flat surface of each holding finger in flat abutment with the toweling.

11. Apparatus for forming the leading edge of the plush portion of uncut toweling and the like as a length of the toweling is advanced along a path over a work surface, a support arm for positioning over the work surface and spanning the path of the toweling, a plurality of holding fingers independently telescopically and pivotably suspended from said support arm, each of said fingers including a downwardly facing effectively flat surface for sliding engagement with the upwardly facing surface of the toweling advancing along the path, means for moving said support arm toward and away from the work surface to place the downwardly facing effectively flat surfaces of said fingers on the toweling for sliding engagement with the toweling, whereby the downwardly facing effectively flat surfaces of the fingers rest in flat abutment with the moving toweling until the leading edge of a plush portion of the toweling engages at least some of the holding fingers whereupon the engaged holding fingers pivot and wedge against the leading edge of the plush portion of the toweling and retard the movement of the toweling.

12. The apparatus of claim 10 and wherein each of said holding fingers comprises an upright stem telescopically and pivotably suspended from said support arm and a foot portion mounted to the lower portion of said stem and suspended below said support arm, spring means for urging each of said holding fingers downwardly with respect to said support arm and for tilting the downwardly facing surface of the finger toward a horizontal attitude.

* * * * *

UNITED STATES PATENT AND TRADEMARK OFFICE

CERTIFICATE OF CORRECTION

PATENT NO. : 4,595,133

DATED : June 17, 1986

INVENTOR(S) : Charles E. Brocklehurst

It is certified that error appears in the above-identified patent and that said Letters Patent are hereby corrected as shown below:

Column 14, line 3, after "fingers" insert --in--.

Signed and Sealed this

*Thirtieth* Day of *September 1986*

[SEAL]

*Attest:*

DONALD J. QUIGG

*Attesting Officer*

*Commissioner of Patents and Trademarks*